US011656027B2

(12) United States Patent
Mondeik et al.

(10) Patent No.: US 11,656,027 B2
(45) Date of Patent: May 23, 2023

(54) BIOMASS DRYING SYSTEM AND METHOD

(71) Applicant: Agra Industries, Inc., Merrill, WI (US)

(72) Inventors: Justin Mondeik, Gleason, WI (US); Benjamin Bostrom, Merrill, WI (US)

(73) Assignee: Agra Industries, Inc., Merrill, WI (US)

( * ) Notice: Subject to any disclaimer, the term of this patent is extended or adjusted under 35 U.S.C. 154(b) by 182 days.

(21) Appl. No.: 17/206,913

(22) Filed: Mar. 19, 2021

(65) Prior Publication Data

US 2021/0293478 A1 Sep. 23, 2021

Related U.S. Application Data

(60) Provisional application No. 62/992,731, filed on Mar. 20, 2020.

(51) Int. Cl.

| | |
|---|---|
| ***F26B 3/16*** | (2006.01) |
| ***F26B 25/22*** | (2006.01) |
| ***F26B 25/00*** | (2006.01) |

(52) U.S. Cl.

CPC ..... *F26B 3/16* (2013.01); *F26B 25/002* (2013.01); *F26B 25/22* (2013.01); *F26B 2200/02* (2013.01)

(58) Field of Classification Search

CPC ..... F26B 3/16; F26B 25/002; F26B 25/22; F26B 2200/02

USPC ..... 34/168

See application file for complete search history.

(56) References Cited

U.S. PATENT DOCUMENTS

| | | | | |
|---|---|---|---|---|
| 2,855,697 | A | 10/1958 | Barre | |
| 3,233,335 | A * | 2/1966 | Neitzel | F26B 25/22 34/550 |
| 3,402,476 | A | 9/1968 | Brock | |
| 3,735,856 | A | 5/1973 | van der Lely et al. | |
| 10,041,732 | B2 * | 8/2018 | Shortt | F26B 5/08 |
| 10,174,997 | B2 | 1/2019 | Loebach | |
| 10,746,465 | B2 | 8/2020 | Bell et al. | |
| 10,962,284 | B2 | 3/2021 | Heine et al. | |
| 11,180,781 | B2 * | 11/2021 | Leo | C12N 1/12 |
| 2010/0287826 | A1 * | 11/2010 | Hoffman | F26B 5/02 209/11 |
| 2015/0027039 | A1 | 1/2015 | Laskowski et al. | |
| 2020/0138051 | A1 | 5/2020 | Pacheco Da Cunha | |
| 2021/0022388 | A1 * | 1/2021 | Sullivan | A24C 5/02 |
| 2021/0105943 | A1 * | 4/2021 | Carr | A01D 45/065 |
| 2021/0293478 | A1 * | 9/2021 | Mondeik | F26B 3/14 |
| 2022/0151980 | A1 * | 5/2022 | Leo | A23G 1/36 |
| 2022/0178559 | A1 * | 6/2022 | Schaefer | F24F 3/1405 |
| 2022/0234078 | A1 * | 7/2022 | Bartrom | B65G 43/08 |

* cited by examiner

*Primary Examiner* — Stephen M Gravini

(74) *Attorney, Agent, or Firm* — Merchant & Gould P.C.

(57) ABSTRACT

A system that facilitates the controlled drying of biomass is provided. The system and method provides automated control over the rate of drying and the moisture content of the resulting product. The system and method also includes auto-loading and unloading, thereby providing a fully automated process. The system and method can be adapted to match the scale of the production and therefore has applicability for large operations as well as micro operations. In addition, since the drying rate and moisture content of the material being dried is monitored and controlled, the system and method can be used to dry products for a wide range of different applications (e.g., drying hemp for medical use as well as for industrial use).

26 Claims, 11 Drawing Sheets

BIOMASS DRYING SYSTEM AND METHOD

CROSS-REFERENCE TO RELATED APPLICATIONS

This application claims priority to U.S. Provisional Application Ser. No. 62/992,731, filed on Mar. 20, 2020, the entire disclosure of which is hereby expressly incorporated herein by reference.

TECHNICAL FIELD

A biomass drying system and method. The system and method facilitates a continuous automated drying process.

BACKGROUND

Post-harvest drying is a key processing step in a number of crop production processes. For example, the moisture content of hemp as harvested can be as high as 80%-85%. If the harvested hemp improperly dries, the hemp can become contaminated by fungi or bacteria and become spoiled and unsuitable for food or medical processing. Conversely, drying hemp well can maximize the quality of food, medicine, or fiber products that can be realized from the harvest. Current drying systems and processes are imprecise, labor intensive, and/or not easily adapted to match the scale of the production. There is a need in the field for improved drying systems and methods.

SUMMARY

The present disclosure provides a system that facilitates the controlled drying of biomass. The system and method of the present disclosure provides automated control over the rate of drying and the moisture content of the resulting product. Some embodiments of the system and method also includes auto-loading and unloading, thereby providing a fully automated drying process. The system and method is easily adapted to match the scale of the production and therefore has applicability in large operations as well as micro operations. In addition, since the drying rate and moisture content of the material being dried is monitored and controlled, the system and method can be used to dry products for a wide range of different applications (e.g., drying hemp for medical use as well as for industrial use).

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following Detailed Description. Embodiments of the present disclosure will hereinafter be described in conjunction with the appended drawings, wherein like numerals denote like elements.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION

Figure 1:
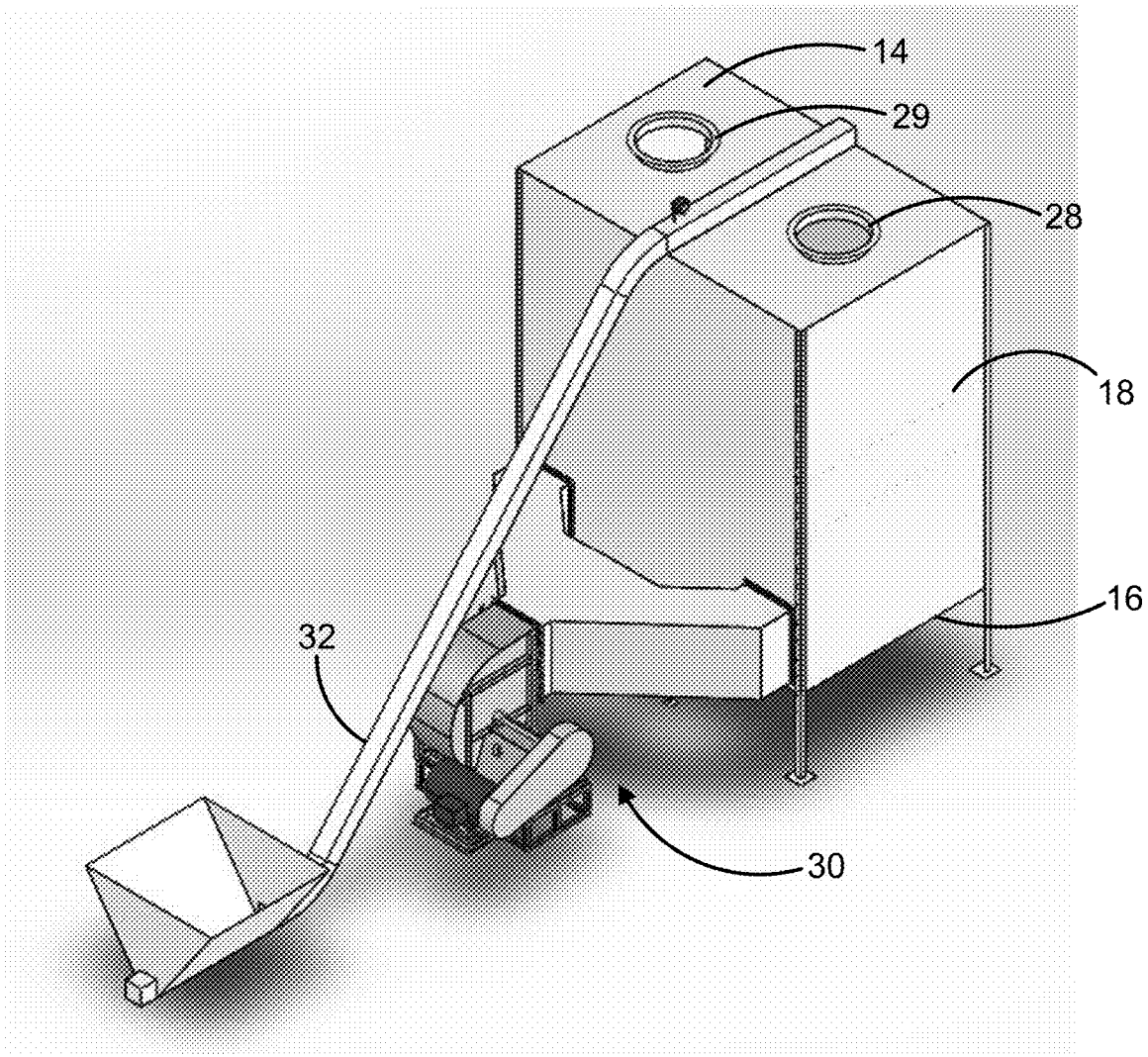
FIG. 1 is an isometric view of a biomass drying system of the present disclosure.
Figure 2:
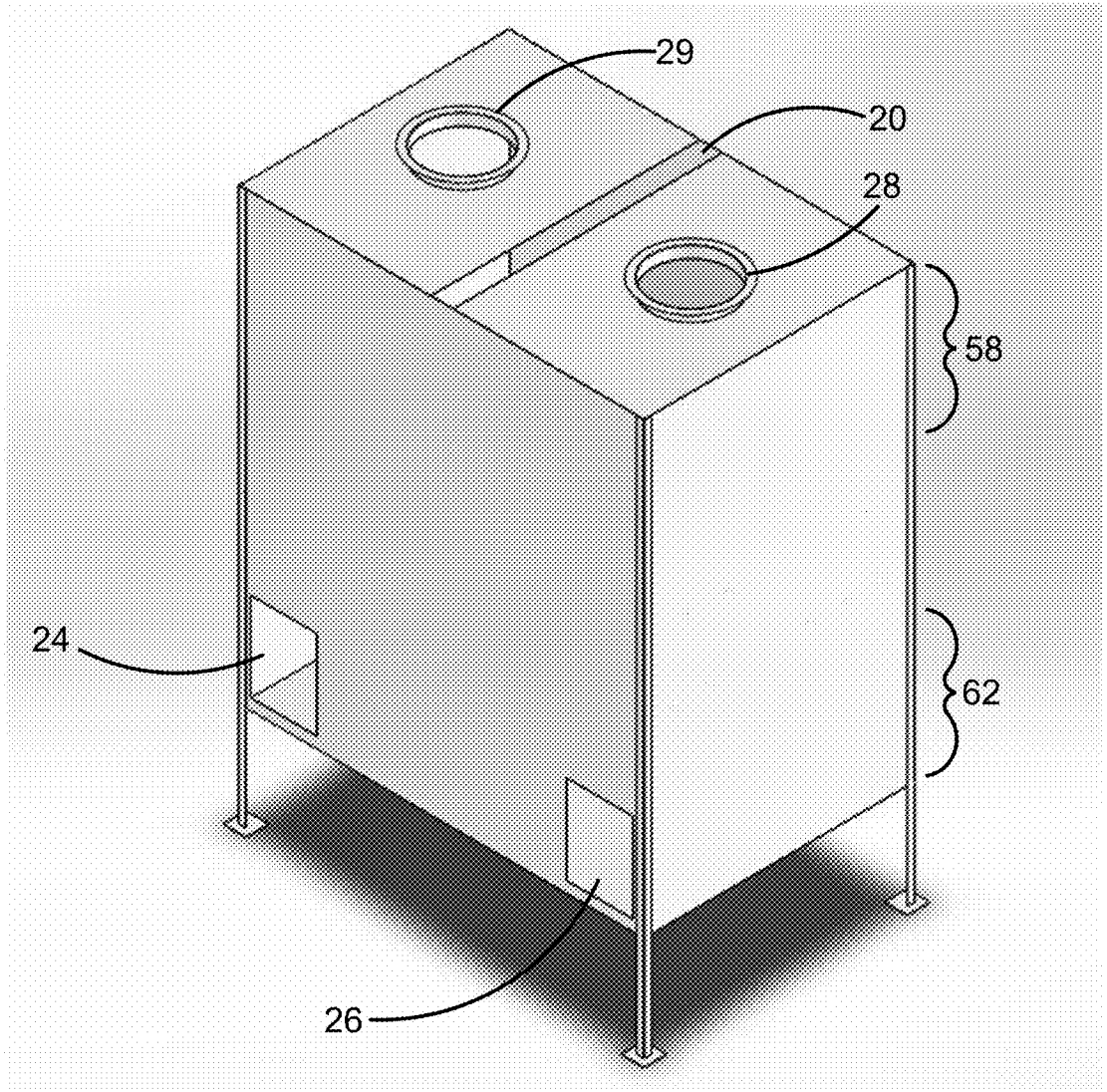
FIG. 2 is an isometric view of a component of the system of FIG. 1.
Figure 3:
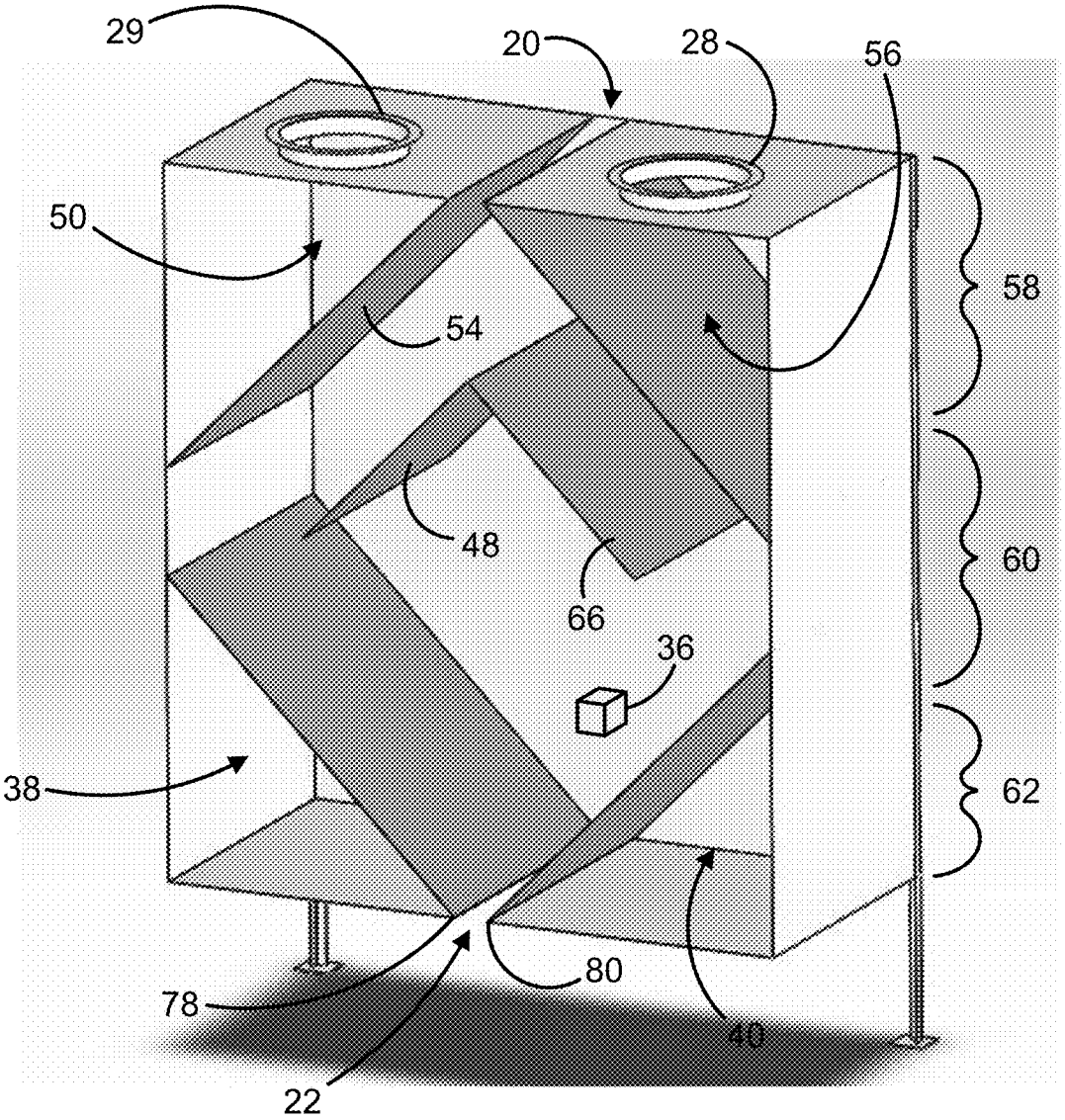
FIG. 3 is the component of FIG. 2 with a wall portion removed to show the internal structure of the component.
Figure 4:
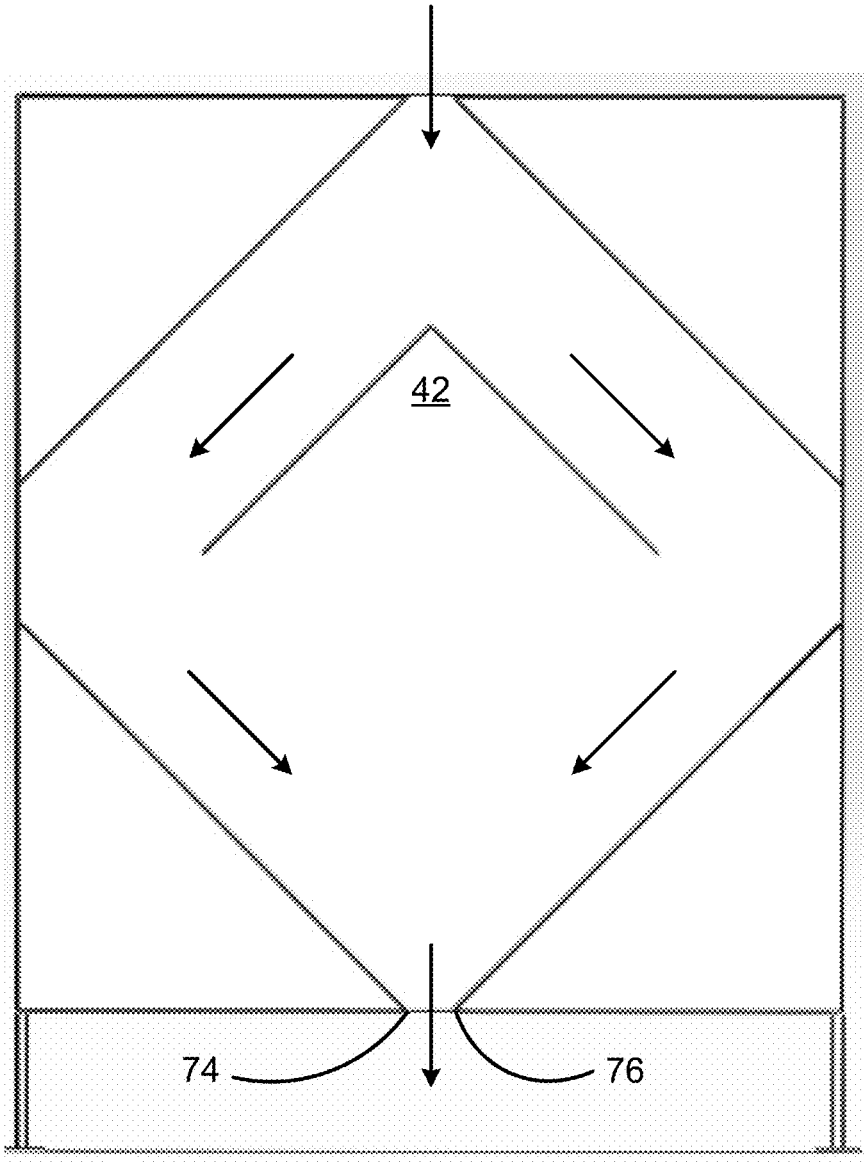
FIG. 4 is a schematic illustration of the flow of biomass through the component of FIG. 2.
Figure 5:
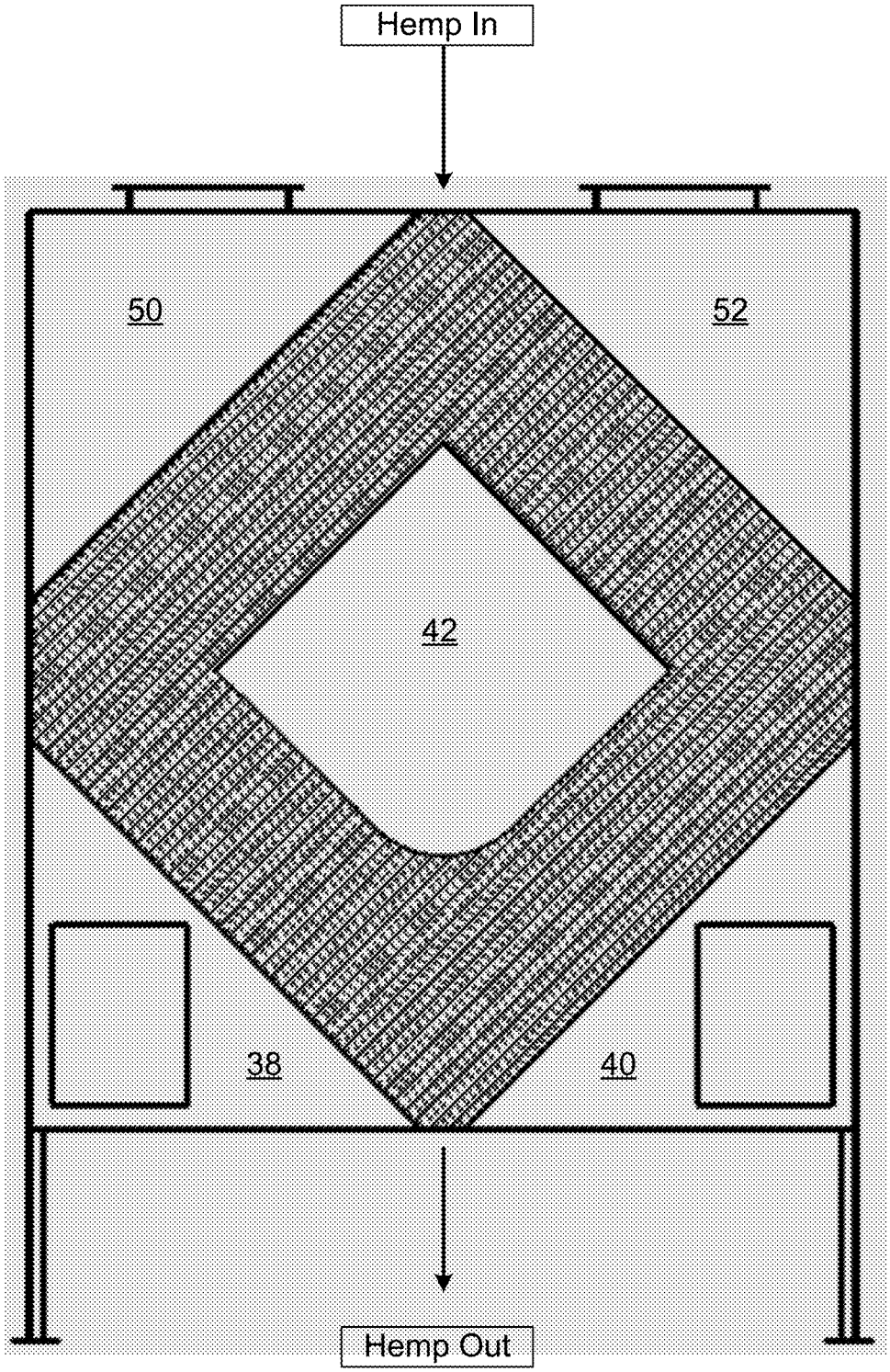
FIG. 5 is a schematic illustration of the component of FIG. 2 fully loaded with biomass.
Figure 6:
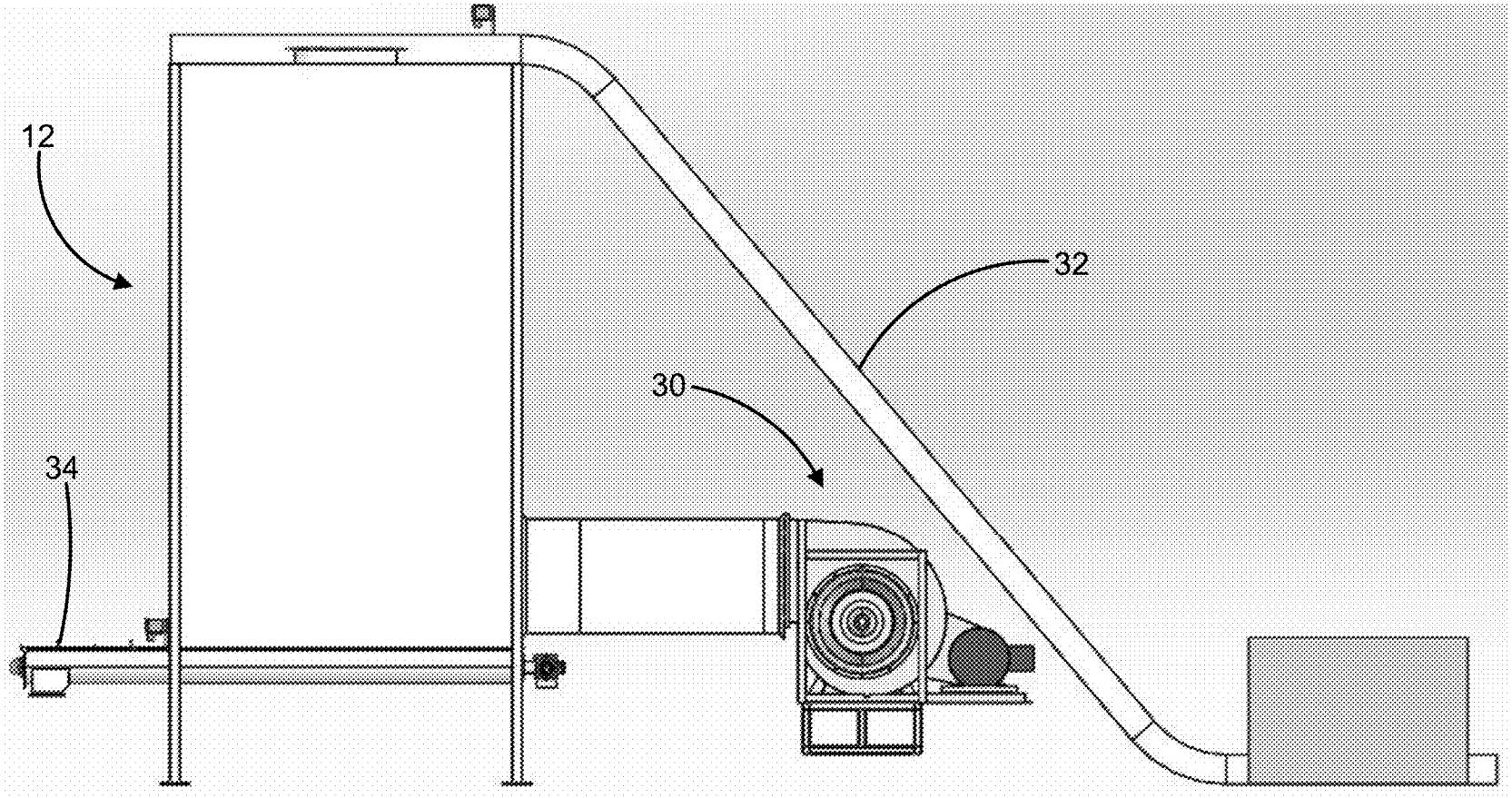
FIG. 6 is a side elevation view of the system of FIG. 1.
Figure 7:
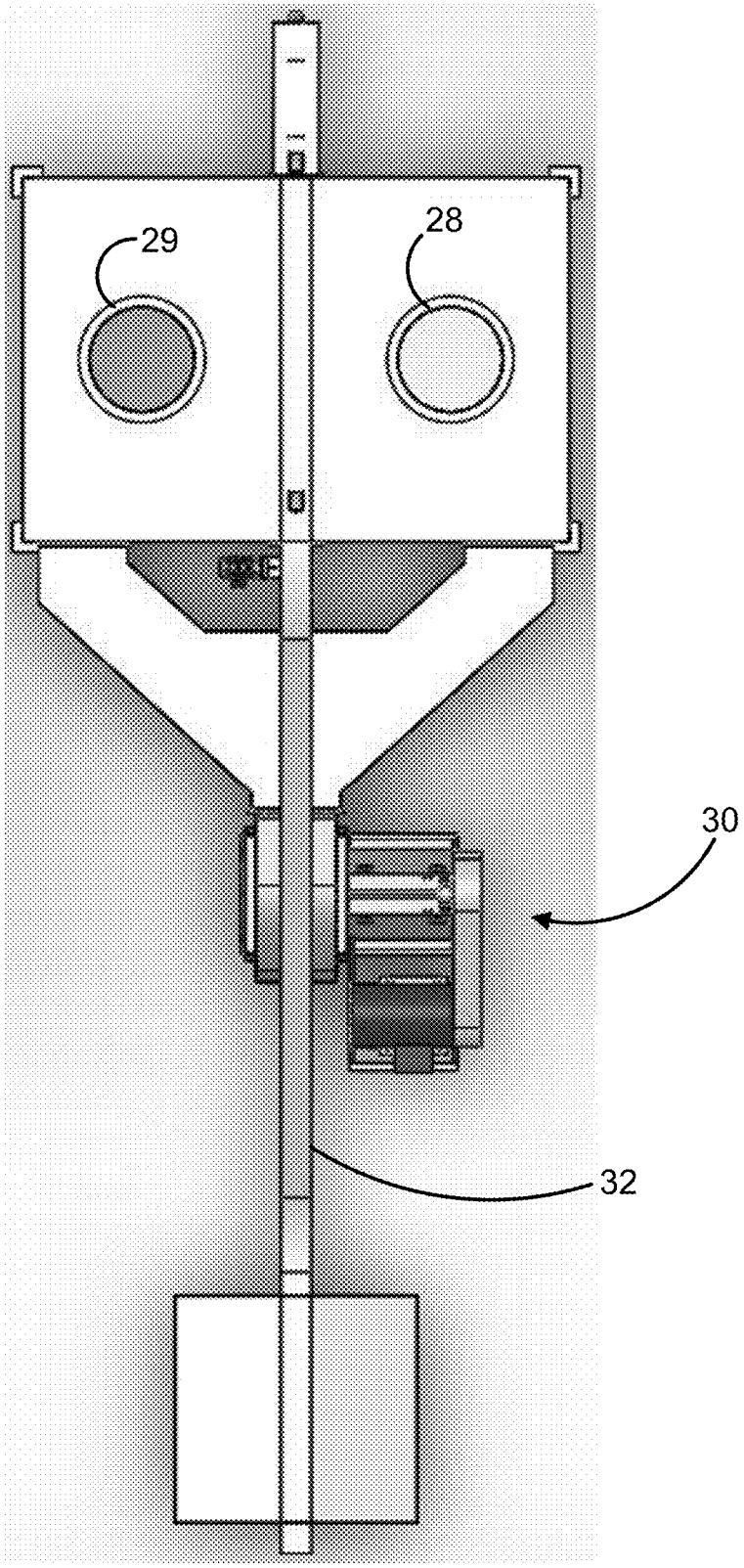
FIG. 7 is a top view of the system of FIG. 1.
Figure 8:
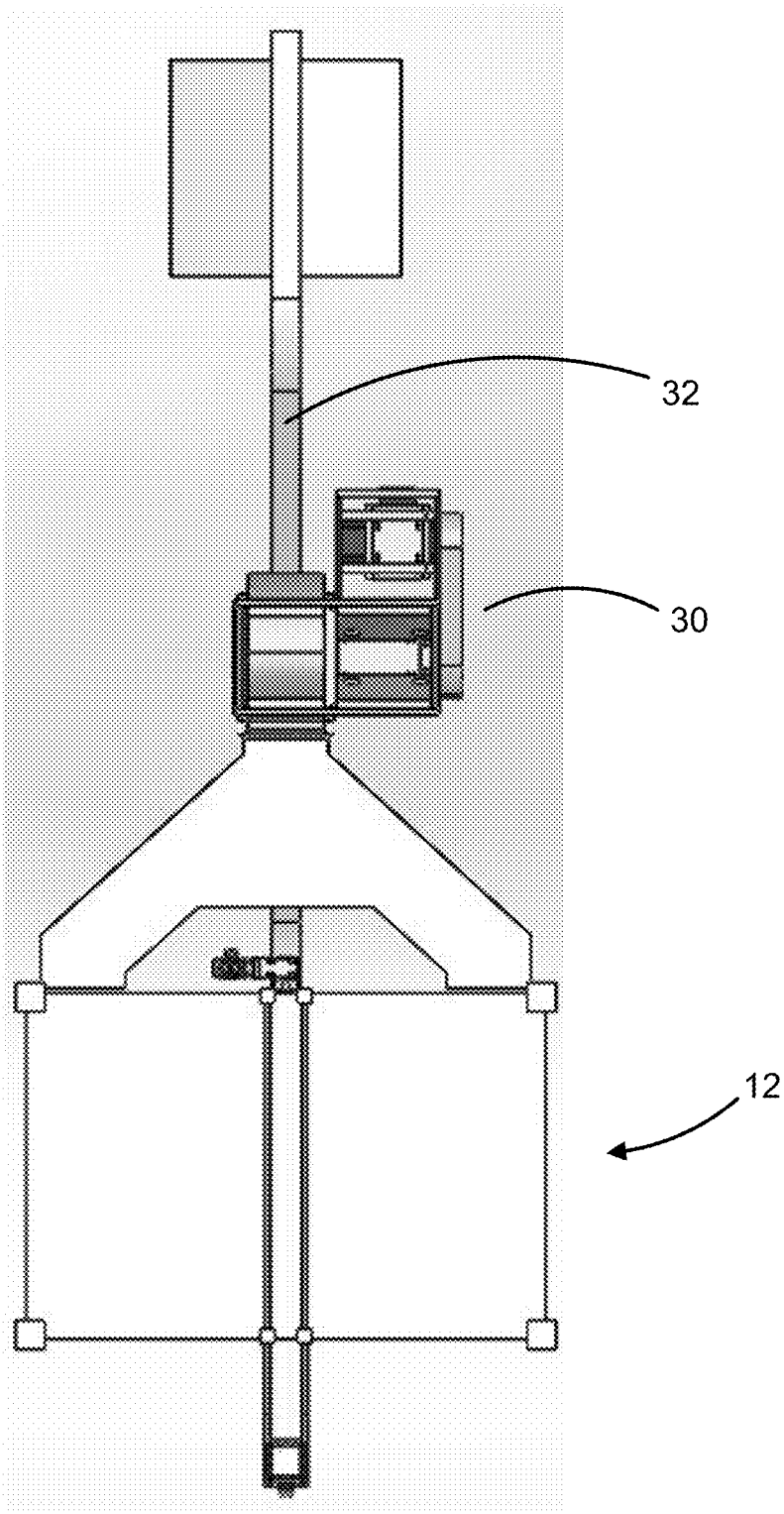
FIG. 8 is a bottom view of the system of FIG. 1.
Figure 9:
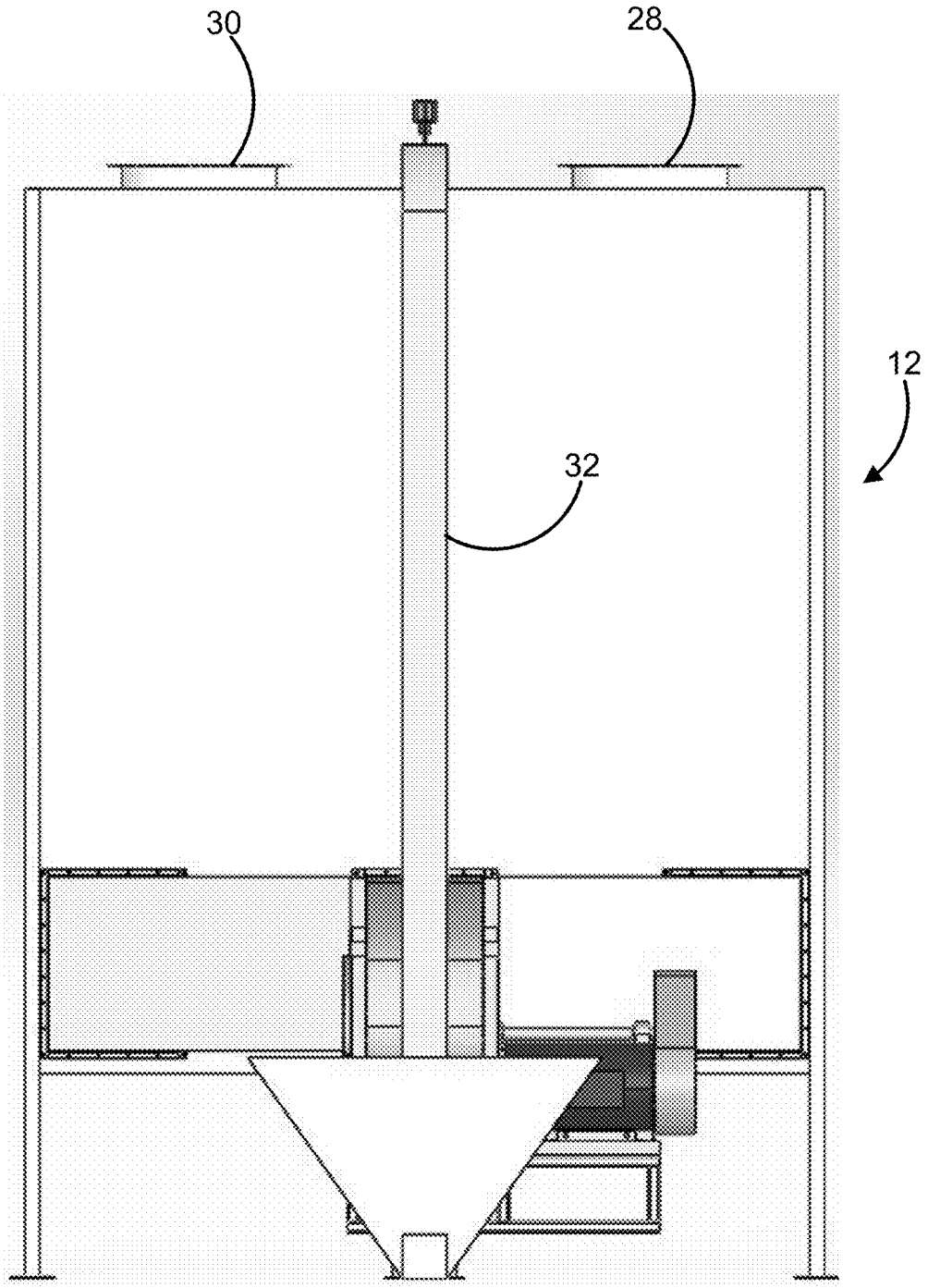
FIG. 9 is a first end view of the system of FIG. 1.
Figure 10:
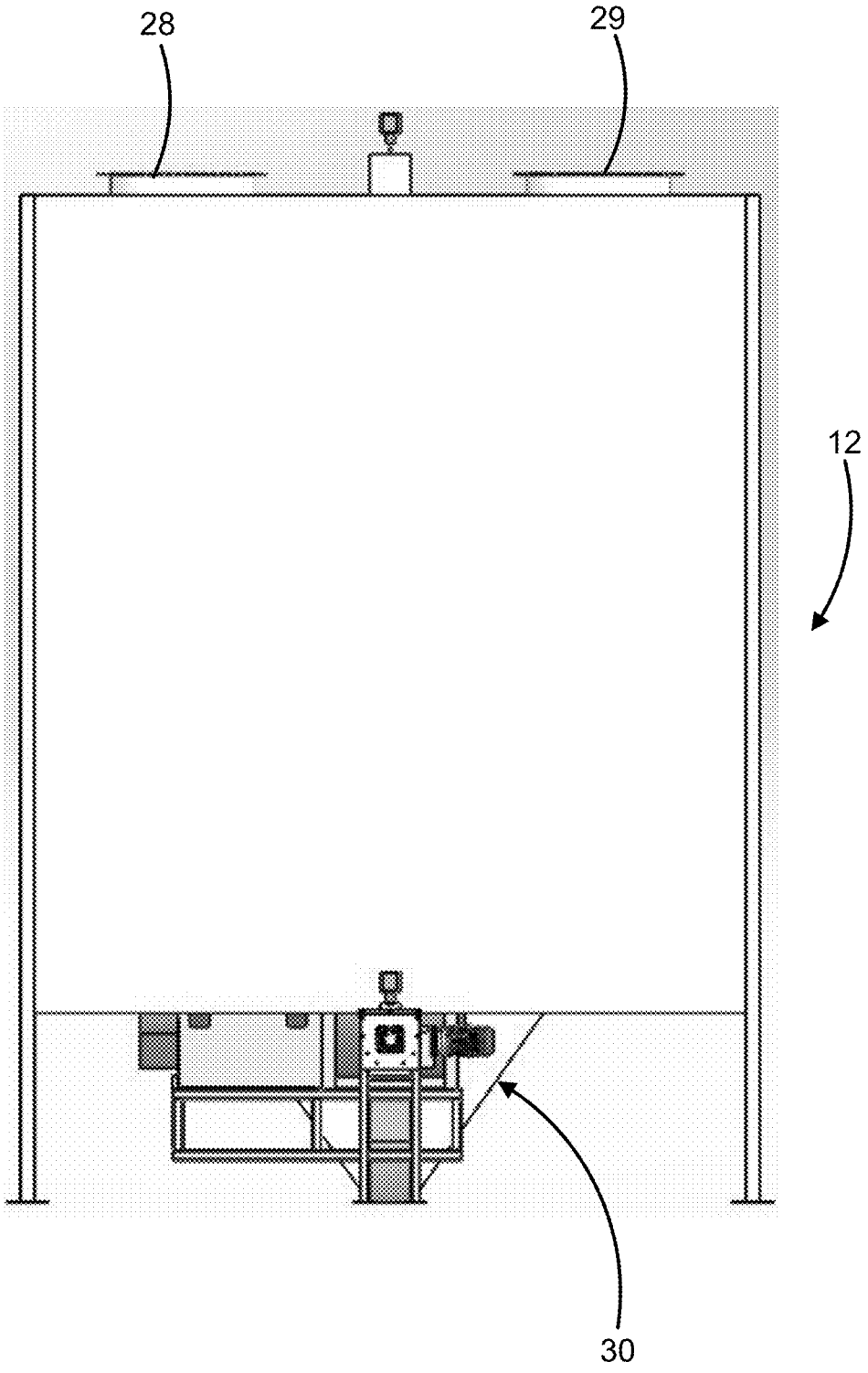
FIG. 10 is a second end view of the system of FIG. 1.

Referring to the figures, a drying system according to an embodiment of the present disclosure is described in further detail. In the depicted embodiment, the drying system 10 includes a housing 12. The housing 12 contains the material to be dried during the drying process. The material to be dried could be any number of materials including, for example, chopped up hemp.

In the depicted embodiment, the housing 12 includes a top 14, a bottom 16, and a side wall 18. The side wall 18 extends between the top 14 and the bottom 16. The housing 12 includes an upper portion 58, a middle portion 60, and a lower portion 62. In the depicted embodiment, the housing 12 has a rectangular cube-like shape. It should be appreciated that many alternative housing configurations are possible.

In the depicted embodiment, the housing 12 also includes a material inlet 20, a material outlet 22, an air inlet 24, 26, and air outlet 28, 29. In the depicted embodiment, the material inlet 20 and the air outlets 28, 29 are located in the upper portion 58 of the housing 12. In the depicted embodiment, the material outlet 22 and the air inlet 24, 26 are located in the lower portion 62 of the housing 12. It should be appreciated that many alternative configurations are possible. For example it should be appreciated that he location and sizes of the air inlets and outlets can vary. For example, in an alternative embodiment the housing may including a single air outlet on the upper portion as opposed to the air outlets 28, 29.

The drying system 10 of the depicted embodiment includes a blower 30 configured to blow air into the air inlet 24, 26. In the depicted embodiment, the blower 30 is a heater and blower combination that is configured to deliver forced heated air to the housing 12. In the depicted embodiment, the air inlet 24, 26 includes a first air inlet 24 and a second air inlet 26. In the depicted embodiment, both the first and second air inlets 24, 26 are located in the lower portion 62 of the housing 12. The drying system 10 of the depicted embodiment includes a loading conveyer 32 configured to load material into the housing 12 and an unloading conveyer 34 configured to move material out of the housing 12. The drying system 10 of the depicted embodiment includes a moisture sensor 36 positioned within the housing 12 to monitor the moisture content of the biomass material in the housing 12. It should be appreciated that many alternative configurations are possible.

In the depicted embodiment, the drying system 10 further includes an electronic control unit and a user interface. An operator can program the drying system 10 to continue to fill the housing 12 and output dried material at a particular target moisture content. If the operator desires that the material be dried faster, the operator can program the blower 30 to force more air into the housing 12 and/or increase the temperature of the air forced into the housing 12. It should be appreciated that many alternative configurations are possible.

In the depicted embodiment, the housing 12 includes a first air inlet chamber 38 and a second air inlet chamber 40. Each of the chambers 38, 40 defines an open air space in the housing 12 that remains open during normal drying operation when material is being housed and moved through the housing 12. In the depicted embodiment, the first and second air inlet chambers 38, 40 are separate discrete areas in the housing 12. In the depicted embodiment, the first and second air inlet chambers 38, 40 are located on opposite sides of the housing 12. It should be appreciated that many alternative configurations are possible.

In the depicted embodiment, the first air inlet chamber 38 is adjacent the first air inlet 24 and the second air inlet chamber 40 is adjacent the second air inlet 26. The first and second air inlet chambers 38, 40 are configured to allow air to flow into and out of the air inlet chambers 38, 40. In the depicted embodiment, the first air inlet chamber 38 is at least partially defined by a first lower material deflector member 44. In the depicted embodiment, the second air inlet chamber 40 is at least partially defined by a second lower material deflector member 46. In the depicted embodiment, the first and second lower material deflector members 44, 46 are perforated metal walls that deflect material away from the air inlets 24, 26 so that the material does not block the first and second air inlets 24, 26. As discussed above, the lower material deflector members 44, 46 define the first and second air inlet chambers 38, 40 in the housing 12. In the depicted embodiment, the bottom 16 of the housing 12 is a solid wall that partially defines the first air inlet chamber 38 and the second air inlet chamber 40 in the housing 12. It should be appreciated that many alternative configurations are possible.

In the depicted embodiment, the first and second lower material deflector members 44, 46 direct the material in the housing 12 (e.g., chopped up hemp) downwardly towards the material outlet 22. The first and second lower material deflector members 44, 46 form a V-shaped funnel that funnels the material in the housing 12 out of the housing 12. The depicted configuration leverages gravity to generate and maintain material flow in the housing 12. In the depicted embodiment, the material outlet 22 is rectangular with two opposed short edges 74, 76 and two opposed long edges 78, 80. In the depicted embodiment, a conveyer 90 is positioned at the material outlet 22 and configured to convey material out of the housing 12 at a controlled rate. In the depicted embodiment, the opposed long edges 78, 80 are coincident with the lower edges of the first and second lower material deflector members 44, 46. When material is conveyed out of the housing 12 through the material outlet 22, the material in the housing 12 settles downwardly opening up more space at the top 14 of the housing 12 to receive more material. In the depicted embodiment, the moisture content of the material near the material outlet 22 is monitored and controlled. The flow rate of material out of the housing 12 is in part determined by the moisture content of the material near the material outlet 22. It should be appreciated that many alternative configurations are possible.

Figure 11:
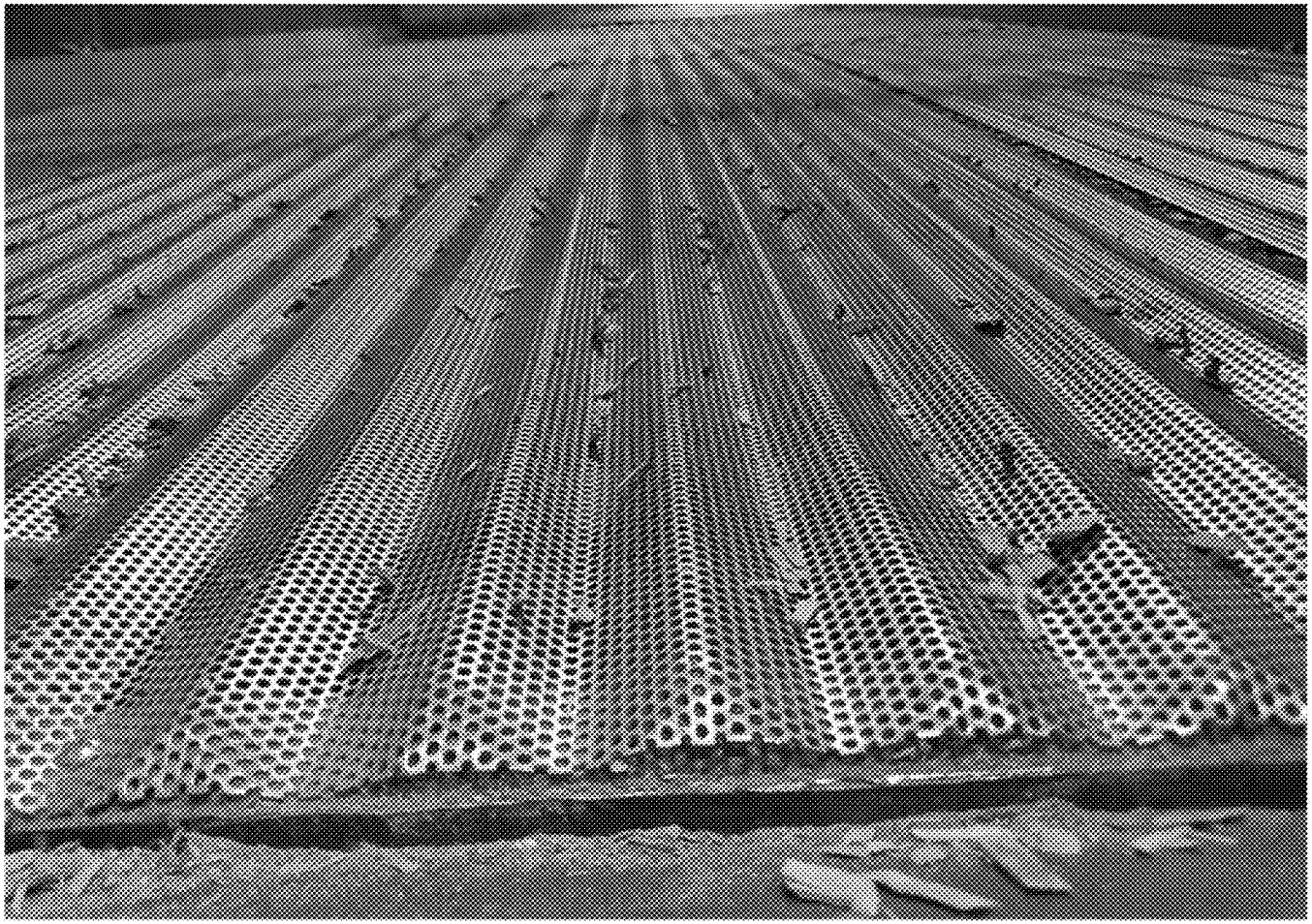
FIG. 11 is an isometric view of a component of the system of FIG. 2.

In the depicted embodiment, the housing 12 includes a center chamber 42 within the housing 12 located in a central portion of the housing 12. The center chamber 42 is configured to allow air flow into and out of the center chamber 42. In the depicted embodiment, the center chamber 42 is at least partially defined by a material deflector 48. In the depicted embodiment, the material deflector 48 defines a roof shape. In the depicted embodiment, the material deflector 48 includes a first angle side 64 and a second angle side 66. In the depicted embodiment, the angled sides 64, 66 are connected at an apex 68. In the depicted embodiment, the apex 68 defines a 30 to 120 degree angle (e.g., 45 degrees). In the depicted embodiment, the material deflector 48 is positioned in the middle portion 60 of the housing 12 with the apex 68 located directly below the material inlet 20 of the housing 12. The material deflector 48 maintains a central open air space (center chamber 42) in the middle portion 60 of the housing 12 and splits the inflow of material from the material inlet 20 to a first side 70 of the housing 12 and a second side 72 of the housing 12. In the depicted embodiment, the material deflector 48 is constructed of a perforated metal sheet. In the depicted embodiment the perforated metal sheet includes an array of holes having a dimeter of 0.15 inches. See, for example, FIG. 11.

The material deflector 48 separates the material in the housing 12 into two sides that each receive forced air from the respective first and second air inlets 24, 26 below. It should be appreciated that many alternative configurations are possible.

In the depicted embodiment, the housing 12 includes a first upper corner air chamber 50 and a second upper corner air chamber 52. Each of the first and second upper corner air chambers 50, 52 are partially defined by a perforated wall 54, 56. In the depicted embodiment, the top 14 of the housing 12 at least partially defines the first upper corner air chamber 50 and the second upper corner air chamber 52 in the housing 12. The upper corner air chambers 50, 52 provide an air flow path and prevents buildup of material in the upper corners. It should be appreciated that many alternative configurations are possible.

In the depicted embodiment, a method of drying biomass such as hemp is provided. The method includes the steps of auto-loading hemp into a hopper (e.g., housing 12), blowing air into the hopper, monitoring the moisture content of the hemp near an outlet of the hopper, auto unloading hemp from the hopper based on the sensed moisture content, and auto-loading the hopper to maintain a particular volume of hemp in the hopper. The blown-in air is directed from an air inlet through the hemp in the hopper top air outlet. It should be appreciated that many alternative steps are possible.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A drying system comprising:

a housing defining an upper portion, a middle portion, and a lower portion;

a material inlet located in the upper portion of the housing;

a material outlet located in the lower portion of the housing;

an air inlet located in the lower portion of the housing;

an air outlet located in the upper portion of the housing;

a middle material deflector positioned in the middle portion of the housing, the middle material deflector configured to maintain a central open air space in the middle portion of the housing, wherein air moves from the air inlet through the central open air space and to the air outlet; and wherein the housing is configured to use gravity for passively moving material from the material inlet to the material outlet.

2. The drying system of claim 1, wherein the middle material deflector is located directly below the material inlet.

3. The drying system of claim 1, wherein the middle material deflector has a roof shape with a first angled side and a second angled side.

4. The drying system of claim 1, wherein the middle material deflector is perforated.

5. The drying system of claim 2, further comprising a lower material deflector, wherein the lower material deflector is configured to maintain a lower open air space in the lower portion of the housing.

6. The drying system of claim 5, wherein the lower material deflector is perforated.

7. The drying system of claim 5, wherein the lower material deflector includes a first member and a second member, wherein the first member is located on a first side of the material outlet and the second member is located on a second side of the material outlet, wherein the first and second members are configured to funnel material in the housing to the material outlet.

8. The drying system of claim 7, wherein the material outlet is rectangular in shape with two opposed short edges and two opposed long edges, wherein the opposed long edges are coincident with lower edges of the first and second members of the lower material deflector.

9. The drying system of claim 1, further comprising an upper material deflector, the upper material deflector including a first member and a second member, wherein the first member is located on a first side of the material inlet and the second member is located on a second side of the material inlet, wherein the first and second members are configured to funnel material in the housing to the material outlet.

10. The drying system of claim 5, wherein the housing includes an air inlet opening to allow air to be blown into the lower open air space.

11. The drying system of claim 5, wherein the lower open air space defined by the lower material deflector includes a first defined area that is spaced apart from a second defined area, wherein the first defined area includes a first air inlet and the second defined area includes a second air inlet.

12. A drying system comprising:

a housing including a top, a bottom, a side wall extending between the top and the bottom, a material inlet, a material outlet, an air inlet, and an air outlet;

a blower configured to blow air into the air inlet;

a loading conveyor configured to load material into the housing;

an unloading conveyor configured to move material out of the housing;

an inlet chamber within the housing adjacent the air inlet, the inlet chamber configured to allow air to flow into and out of the inlet chamber; and a center chamber within the housing located in a central portion of the housing, the center chamber configured to allow air flow into and out of the center chamber;

wherein the housing is configured to use gravity for passively moving material from the material inlet to the material outlet.

13. The drying system of claim 12, wherein the housing includes at least a first air inlet and a second air inlet, wherein the first air inlet is adjacent a first air inlet chamber in the housing and the second air inlet is adjacent a second air inlet chamber in the housing.

14. The drying system of claim 13, wherein each of the air inlet chambers is at least partially defined by a perforated wall member.

15. The drying system of claim 12, wherein the center chamber is at least partially defined by a perforated wall.

16. The drying system of claim 15, wherein the perforated wall defines a roof shape and is directly below the material inlet of the housing.

17. The drying system of claim 13, wherein the first and second air inlets are located in a lower portion of the housing and the bottom of the housing at least partially defines the first air inlet chamber and the second air inlet chamber in the housing.

18. The drying system of claim 13, further comprising a first upper corner air chamber and a second upper corner air chamber, wherein each of the first and second upper corner air chambers is partially defined by a perforated wall.

19. A method of drying biomass comprising:

auto-loading biomass into a hopper at an inlet;

blowing air into the hopper;

monitoring a moisture content of the biomass near an outlet of the hopper; and auto unloading biomass from the hopper based on the sensed moisture content and auto loading the hopper to maintain a particular volume of biomass in the hopper;

wherein the blown-in air is directed from an air inlet through the biomass in the hopper and through an upper air outlet; and wherein the biomass is divided by a central material deflector and regrouped by a lower material deflector as the biomass moves through the hopper from the inlet to the outlet.

20. The drying system of claim 12, wherein the drying system includes a moisture sensor.

21. The drying system of claim 20, wherein the moisture sensor is located near the material outlet.

22. A drying system comprising:

a housing defining an upper portion, a middle portion, and a lower portion, the housing having a first side and a second side;

a material inlet located in the upper portion of the housing and centered between the first side and the second side;

a material outlet located in the lower portion of the housing and centered between the first side and the second side;

a first air inlet and a second air inlet located in the lower portion of the housing, wherein the first air inlet partially defines a first air inlet chamber on the first side of the housing and the second air inlet partially defines a second air inlet chamber on the second side of the housing;

a first air outlet and a second air outlet located in the upper portion of the housing, wherein the first air outlet partially defines a first air outlet chamber on the first side of the housing and the second air outlet partially defines a second air outlet chamber on the second side of the housing;

a middle material deflector positioned in the middle portion of the housing and centered below the material inlet, the material deflector having a first angled surface and a second angled surface forming a roof shape and configured to divide incoming material from the material inlet between the first side and the second side of the housing, the middle material deflector configured to maintain a central open air space in the middle portion of the housing, wherein air moves from the first and second air inlets through the central open air space and to the first and second air outlets; and a lower material deflector positioned in the lower portion of the housing and having a first merging surface on the first side of the housing and a second merging surface on the second side of the housing, the first merging surface partially defining the first air inlet chamber and the second merging surface partially defining the second air inlet chamber, wherein the first merging surface and the second merging surface are angled to regroup material over the material outlet;

wherein the housing is configured to use gravity for moving material from the material inlet to the material outlet without machinery.

23. A drying system comprising:

a housing having an inlet at a top side and an outlet at a bottom side;

a first material deflector positioned below the inlet and angled downwardly toward the bottom side and a first side of the housing;

a second material deflector positioned below the first material deflector and angled downwardly toward the bottom side and a second side of the housing;

a material passage gap between the first material deflector and the second material deflector, the material passage gap configured to enable material to flow from the first material deflector to the second material deflector;

an air outlet chamber partially defined by the top side of the housing;

an air inlet chamber partially defined by the bottom side of the housing and the second material deflector;

a central air chamber partially defined by the first material deflector;

the first and second material deflectors having perforations sized to enable air passage without material passage, wherein the housing is configured to use gravity for passively moving material from the material inlet along the first material deflector through the material passage gap then along the second material deflector to the material outlet, wherein the housing is configured to enable airflow from the air outlet through the second material deflector to the central air chamber and from the central air chamber through the first material deflector to the air outlet chamber.

24. A drying system comprising:

a housing having an inlet and an outlet, the drying system being configured such that, in use, biomass desired to be dried flows by gravity from the inlet to the outlet;

an upper material deflector positioned within the housing, the upper material deflector angling downwardly and in a first lateral direction from an upper end portion to a lower end portion, the upper end portion of the upper material deflector being positioned below the inlet and the lower end portion of the upper material deflector being offset from a side wall of the housing such that a gap is defined between the lower end portion of the upper material deflector and the side wall; and a lower material deflector positioned within the housing at a location below the upper material deflector, the lower material deflector angling downwardly and in a second lateral direction from an upper end portion of the lower material deflector to a lower end portion of the lower material deflector, the second lateral direction being opposite from the first lateral direction, the upper end portion of the lower material deflector being positioned beneath the gap and the lower end portion of the lower material deflector extending to the outlet;

the upper and lower material deflectors being air permeable;

the drying system being configured such that an upper drying region is provided on the upper material deflector and a lower drying region is provided on the lower material deflector, the drying system being configured such that, in use, an open region is defined beneath upper material deflector above the lower drying region;

the drying system including an air flow system configured for directing air along a flow path that extends: a) upwardly though the lower material deflector and the lower drying region to the open region; and b) from the open region upwardly through the upper material deflector and the upper drying region.

25. The drying system of claim 24, wherein the drying system is configured for drying hemp.

26. The drying system of claim 24, further comprising an inlet air plenum positioned within the housing beneath the lower material deflector and an outlet air plenum positioned above the upper drying region, the upper air plenum being separated from the upper drying region by an air permeable plate.

* * * * *